US009276332B2

(12) United States Patent
Tagan et al.

(10) Patent No.: US 9,276,332 B2
(45) Date of Patent: Mar. 1, 2016

(54) HIGH-TEMPERATURE RF CONNECTOR

(71) Applicant: FCT, US LLC, Torrington, CT (US)

(72) Inventors: Kevin John Tagan, Torrington, CT (US); Jason Erik Deren, West Hartford, CT (US)

(73) Assignee: FCT, US L.L.C., Torrington, CT (US)

( * ) Notice: Subject to any disclaimer, the term of this patent is extended or adjusted under 35 U.S.C. 154(b) by 0 days.

(21) Appl. No.: 13/833,203

(22) Filed: Mar. 15, 2013

(65) Prior Publication Data

US 2014/0273622 A1 Sep. 18, 2014

(51) Int. Cl.
*H01R 9/05* (2006.01)

(52) U.S. Cl.
CPC ..... *H01R 9/0521* (2013.01)

(58) Field of Classification Search
CPC .... H01R 9/0518; H01R 9/0521; H01R 9/053; H01R 2103/00
USPC ..... 439/394, 578–585
See application file for complete search history.

(56) References Cited

U.S. PATENT DOCUMENTS 5,217,391 A * 6/1993 Fisher, Jr. ..... 439/578
5,394,119 A 2/1995 Pleva et al.
5,938,474 A * 8/1999 Nelson ..... 439/583
6,019,635 A * 2/2000 Nelson ..... 439/583
6,094,161 A 7/2000 Cassen et al.
6,979,239 B1 12/2005 Richard et al.
7,097,486 B2 * 8/2006 Parsons ..... 439/291
7,131,867 B1 11/2006 Foster et al.
7,230,384 B2 6/2007 Kialashaki et al.
7,249,969 B2 * 7/2007 Paynter ..... 439/578
7,527,524 B1 * 5/2009 Coleman et al. ..... 439/578
7,731,529 B1 * 6/2010 Islam ..... 439/583
7,798,847 B2 * 9/2010 Islam ..... 439/578
7,798,848 B2 * 9/2010 Islam ..... 439/578
7,803,018 B1 * 9/2010 Islam ..... 439/583
7,871,295 B2 * 1/2011 Zhang et al. ..... 439/578
7,972,176 B2 * 7/2011 Burris et al. ..... 439/584
8,206,176 B2 * 6/2012 Islam ..... 439/578

* cited by examiner

*Primary Examiner* — Thanh Tam Le
(74) *Attorney, Agent, or Firm* — Stephen L. Sheldon

(57) ABSTRACT

An electrical connector includes a substantially cylindrical conducting outer body and coaxial contact portion; the outer body having an opening for receiving an end of a cable; a ceramic annular insulator surrounding the contact portion, thereby electrically isolating the contact portion from the outer body; a connecting body connecting to the outer body and coaxial with the opening; and a ring having an exterior surface in contact with an interior surface of the clamp body and coaxial with the opening. The contact portion includes front and rear portions; the rear portion has a hole therein, substantially coaxial with the opening in the outer body, and a slot intersecting the hole for making a solderless connection to a central conductor of the cable. The ring has a slot therein, the ring thereby being closable to make a solderless connection to an outer conductor of the cable.

14 Claims, 5 Drawing Sheets

HIGH-TEMPERATURE RF CONNECTOR

FIELD OF THE DISCLOSURE

This disclosure relates to electrical devices, and more particularly to radio-frequency (RF) connectors suitable for high-temperature environments.

BACKGROUND OF THE DISCLOSURE

RF cables and connectors are used in a wide variety of applications. RF connectors are typically used with coaxial cables; in an arrangement including cables and RF connectors, the connectors generally offer shielding in accordance with the coaxial design of the cable.

In some situations, for example military applications, coaxial RF connectors must perform in harsh environments. In particular, high-temperature operation may require a solderless connection between the RF connector and the cable.

Accordingly, it is desirable to implement a design for an RF connector suitable for high temperatures, with respect to both its composition and design.

SUMMARY OF THE DISCLOSURE

According to an aspect of the disclosure, an electrical connector includes a substantially cylindrical conducting outer body, a conducting contact portion coaxial therewith, an annular insulator within the outer body, and an annular interface gasket within the outer body. The insulator surrounds the contact portion and electrically isolates the contact portion from the outer body. The insulator is formed from a material that maintains its form and properties at temperatures above 275° C.; the insulator may be a ceramic or glass. The interface gasket is formed from an elastomer material that maintains its form and properties at temperatures above 275° C. The electrical connector has electrical properties for use at microwave frequencies and provides a solderless connection to a coaxial cable, a printed circuit board and/or a bulkhead. Microwave frequencies are from 100 MHz to 100 GHz.

In an embodiment, the outer body of the connector has an opening for receiving an end of a cable. The connector may also include a conducting contact portion coaxial with the outer body; a ceramic annular insulator within the outer body and surrounding the contact portion, electrically isolating the contact portion from the outer body; a substantially cylindrical connecting body connecting to the outer body and coaxial with the opening; and a ring having an exterior surface in contact with an interior surface of the connecting body and coaxial with the opening. To form a solderless connection to the cable, the contact portion may include front and rear portions, with the rear portion having a hole therein substantially coaxial with the opening and a slot intersecting the hole for making a connection to a central conductor of the cable. The ring has a slot therein and is closable by narrowing the slot; closing the ring makes the solderless connection to an outer conductor of the cable.

In an embodiment, the slot in the rear portion separates a first section and a second section of the rear portion; the hole in the rear portion has a diameter less than that of the central conductor, so that forcing the central conductor into the hole causes the slot to widen and the first section and the second section to resist being spread apart, thereby clamping the central conductor to the contact portion.

In a further embodiment, the annular insulator includes a first ceramic insulator and a second ceramic insulator surrounding the contact portion, and a gasket disposed axially between the first and second insulators; the gasket is formed of an elastomer material. The elastomer material may be specified as rated for use at a temperature of at least 315° C., and for continuous duty at 300° C. The elastomer material may be a perfluoroelastomer.

According to another aspect of the disclosure, an electrical connector includes a substantially cylindrical conducting outer body; a conducting contact portion coaxial with the outer body and including a front portion and a rear portion; and first and second annular insulators disposed within the outer body and surrounding the front portion and the rear portion respectively, thereby electrically isolating the contact portion from the outer body. The first insulator and second insulator are formed from a ceramic or glass material. In an embodiment, the connector is configured for mounting to a bulkhead, and further includes an O-ring for contacting a surface of the bulkhead; the O-ring surrounds the outer body and is formed of an elastomer material. The elastomer material may be specified as rated for use at a temperature of at least 315° C., and for continuous duty at 300° C.; the elastomer material may be a perfluoroelastomer.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

DETAILED DESCRIPTION

The embodiments described herein relate to a plug/jack combination of RF connectors. It will be appreciated, however, that the disclosure is not limited to any particular type or design of connector.

Figure 1:
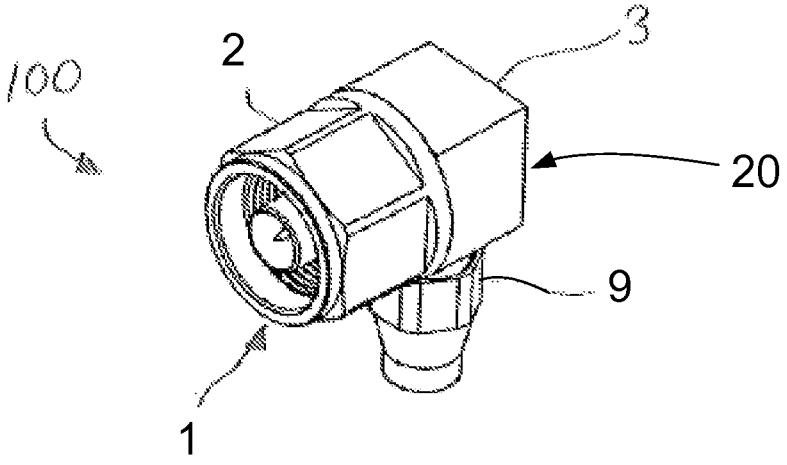
FIG. 1 is a perspective view of a high-temperature RF plug in accordance with an embodiment of the disclosure.

FIG. 1 shows a right-angle RF plug in accordance with an embodiment of the disclosure. Plug 100 includes a front body 1 with a coupling nut 2 on the exterior thereof, and a rear body 3 with a threaded portion 3*a* for connecting to a cable (not shown) at a right angle to the front body 1. The front body 1 and rear body 3 can be collectively considered an outer body 20. The cable is secured to the rear body 3 using connecting body 9 in a solderless connection, described in more detail below. The cable is typically a semi-rigid cable with a central conductor and a coaxial outer conductor.

Figure 2:
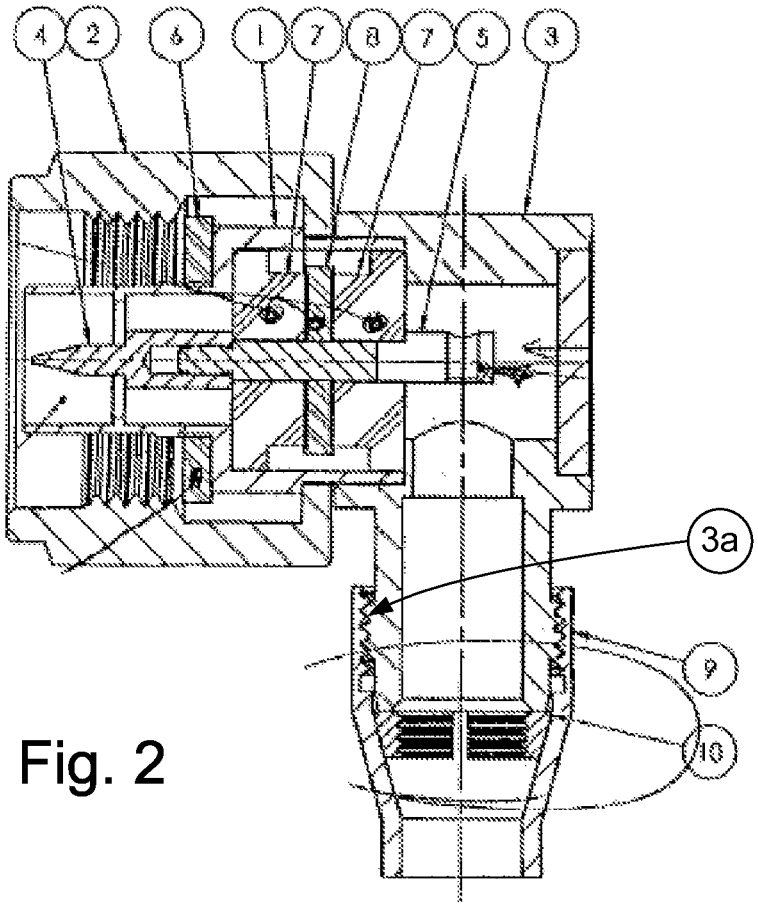
FIG. 2 is a section view of the high-temperature RF plug of FIG. 1.

FIG. 2 is a cross-section view of the RF plug of FIG. 1. Front contact 4 is secured by a press fit to the forward end of contact 5; the rear end of contact 5 has a hole and a slot for receiving the cable conductor. The front body 1 and the rear body 3 each have a recess formed therein, in which is seated an insulator 7. In this embodiment, a gasket 8 separates the two insulators. As shown in FIG. 2, the insulators and gasket each have a central hole on a common axis, for holding contact 5. The electrically conductive components, all but gaskets 6, 8 and insulator 7 are formed from an electrically conductive material. Exemplary is brass, but other suitable materials, such as beryllium copper or stainless steel, may be used.

Figure 3:
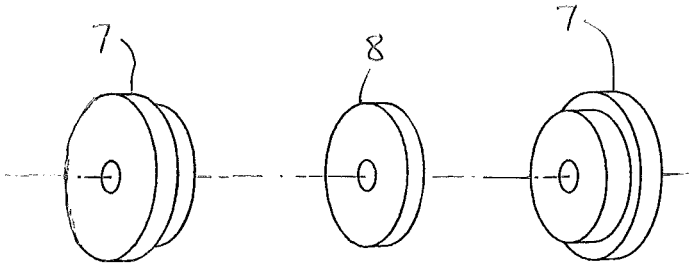
FIG. 3 shows the high-temperature insulators and gasket used in the RF plug of FIG. 1.

The insulators 7 and gasket 8 form a three-piece assembly (FIG. 3) of high-temperature dielectric materials. Each insulator 7 may be formed from a ceramic material, or alternatively from a glass material. In this embodiment, each insulator 7 is formed from a ceramic material that is 96%, by weight, aluminum oxide. An exemplary composition, by weight, is 96.01% $Al_2O_3$, 2.31% $SiO_2$, 0.69% MgO, 0.69% CaO, 0.07% $Fe_2O_3$ and the balance alkalis such as $K_2O$, $Na_2O$ and $Li_2$).

Gasket 8 serves as a shock absorber; in an embodiment, gasket 8 is formed from an elastomer material (e.g. a perfluoroelastomer) rated for use in high-temperature environments (for example, rated for use at a temperature of at least 315° C., with continuous duty at 300° C.).

Referring back to FIG. 2, plug 100 also has an interface gasket 6 on a forward-facing exterior surface of front body 1. The interface gasket surrounds the forward portion of front body 1 and front contact 4. When RF plug 1 is connected to a jack using coupling nut 2, the proximal end of the jack seats against the forward surface of interface gasket 6. The interface gasket is formed from a high-temperature material such as a perfluoroelastomer.

Figure 4:
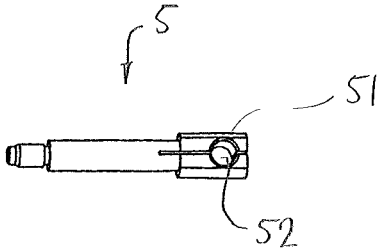
FIG. 4 is an isolated perspective view of a solderless contact in a high-temperature RF connector, in accordance with an embodiment of the disclosure.
Figure 5:
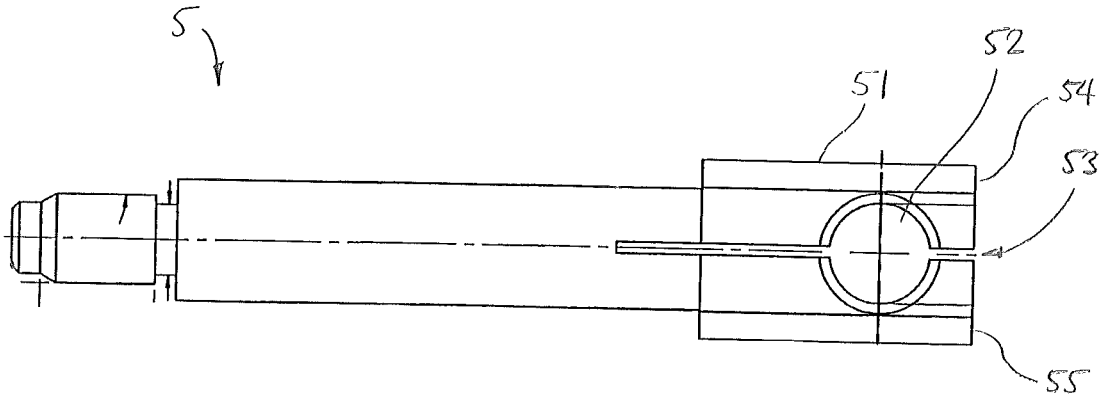
FIG. 5 is a section view of the solderless contact of FIG. 4.

Contact 5 connects to the central conductor of a cable using a solderless connection. As shown in FIG. 4, contact 5 has a rear portion 51 with a hole 52 therein. Hole 52 is located on the axis of the rear body 3 (see FIG. 2), so that the central conductor of a cable connecting to the plug is aligned with the hole. A slot 53 intersects hole 52 and extends along the axis of rear portion 51; slot 53 splits rear portion 51 into two sections 54, 55 (see FIG. 5). Hole 52 is sized to have a diameter slightly less than that of the conductor. When the conductor is forced into the hole, slot 53 is slightly widened and the two sections 54, 55 are spread slightly apart. Sections 54, 55 resist being spread apart and accordingly close on the conductor, clamping the conductor to the contact 5.

Figure 6:
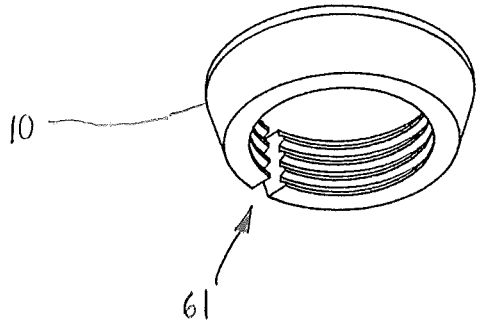
FIG. 6 is an isolated perspective view of a clamp ring used to make a solderless connection of a cable to a high-temperature RF connector.

Referring again to FIG. 2, the rear body 3 connects to the outer conductor of the cable using another solderless connection. A connecting body 9, sized to slide over the end portion of the cable, engages with the rear body 3 via a threaded connection. As shown in FIG. 2, ring 10 fits inside connecting body 9 and has a tapered exterior wall meeting the tapered interior wall of connecting body 9. Ring 10 has a slot 61 therein (see FIG. 6), so that the ring is closable by narrowing the slot. When the cable is connected to the plug, the cable is inserted through the ring 10. As the connecting body 9 is threaded onto rear body 3, the tapered profile of connecting body 9 forces ring 10 to close around the outer conductor.

Figure 7:
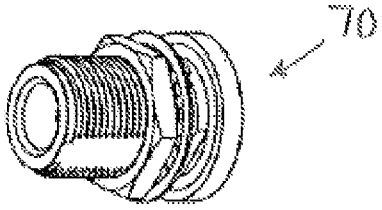
FIG. 7 is a perspective view of a high-temperature RF jack in accordance with an embodiment of the disclosure.
Figure 8:
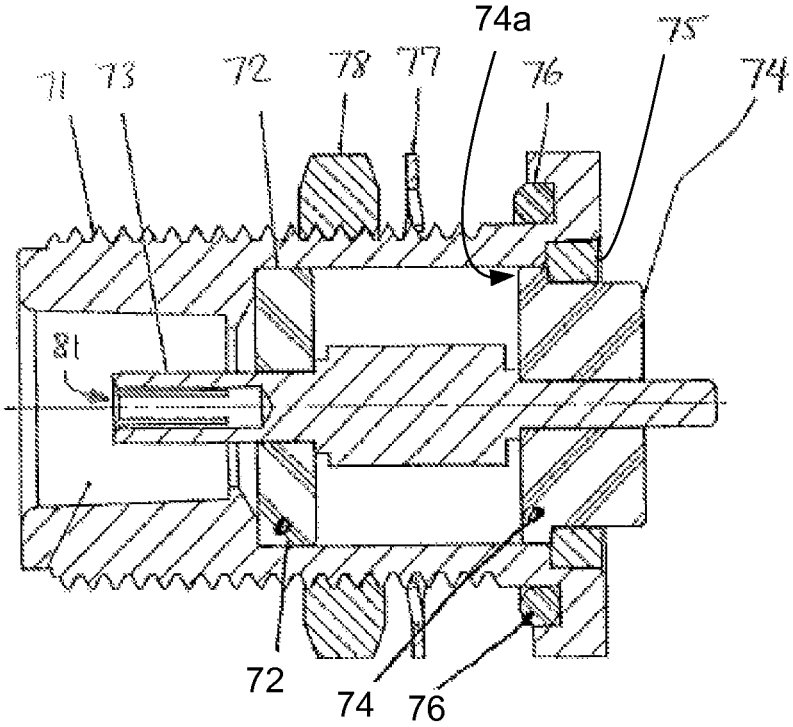
FIG. 8 is a section view of the high-temperature RF jack of FIG. 7.

FIG. 7 illustrates an RF jack 70 suitable for use in high-temperature environments, in accordance with another embodiment of the disclosure. Jack 70 is designed as a rear-mount bulkhead connector, for mating with plug 100. As shown in FIG. 8, the jack has a body 71 with external threads, and a central contact 73 with an axial hole 81. When plug 100 is mated with jack 70, coupling nut 2 of the plug makes a threaded connection with jack body 72 while the front contact 4 of the plug engages hole 81 of the jack contact Annular insulators, including front insulator 72 and rear insulator 74 with a lip 74*a*, surround contact 73 and hold the contact 73 in an axial position. In this embodiment, a retaining ring 75 surrounds rear insulator 74 and holds the rear insulator 74 in place relative to the body 71 via the lip 74*a*. Lock washer 77 and nut 78 are disposed about the external threads; when the jack is mounted to a bulkhead (not shown). Nut 78 is tightened against the front surface of the bulkhead while O-ring 76 seats against the rear surface of the bulkhead.

Front insulator 72, rear insulator 74, and O-ring 76 are formed from high-temperature dielectric materials. The front and rear insulators 72, 74 may be formed from a ceramic material, or alternatively from a glass material. In an embodiment, the insulators are formed from a ceramic material that is 96%, by weight, aluminum oxide. O-ring 76 may be formed from an elastomer material (e.g. a perfluoroelastomer) rated for use in high-temperature environments (for example, rated for use at a temperature of at least 315° C., with continuous duty at 300° C.).

While the disclosure has been described in terms of specific embodiments, it is evident in view of the foregoing description that numerous alternatives, modifications and variations will be apparent to those skilled in the art, for example, one or more of the connections may be soldered. Accordingly, the disclosure is intended to encompass all such alternatives, modifications and variations which fall within the scope and spirit of the disclosure and the following claims.

We claim:

1. An electrical connector comprising:

a substantially cylindrical conducting front body having a central bore extending along a longitudinal axis thereof;

a conducting contact portion disposed within the central bore and longitudinally coaxial with the front body;

an annular insulator disposed within the front body and surrounding the contact portion, thereby electrically isolating the contact portion from the front body, wherein the insulator is formed from a material that maintains the insulator's form and properties at temperatures above 275° C.;

an annular interface gasket disposed within the front body, wherein the interface gasket is formed from an elastomer material that maintains the interface gasket's form and properties at temperatures above 275° C.;

a rear body with a threaded portion; and a connecting body with a ring, wherein the connecting body is tapered so that, in operation, threading the connecting body onto the threaded portion causes the ring to close on a coaxial cable that includes an outer conductor, thereby clamping the outer conductor to the rear body.

2. An electrical connector according to claim 1, wherein the insulator is formed from a ceramic or a glass suitable for use at temperatures above 275° C.

3. An electrical connector according to claim 1, wherein the rear body has an opening configured to receive an end of a coaxial cable that includes a central conductor; and the contact portion includes a front portion and a rear portion, the rear portion having a hole therein substantially coaxial with the opening and having a diameter configured to be less than that of the central conductor, and a slot intersecting the hole for making a connection to a central conductor of the cable, the slot separating a first section and a second section of the rear portion, so that, in operation, forcing the central conductor into the hole causes the slot to widen and the first section and the second section to resist being spread apart, thereby clamping the central conductor to the contact portion to form a solderless connection to the coaxial cable.

4. An electrical connector according to claim 1, wherein the elastomer material is a material suitable for use at temperatures above 275° C.

5. The electrical connector of claim 3, wherein the central contact extends at a 90 degree angle from the central bore.

6. An electrical connector comprising:

a substantially cylindrical conducting outer body with a front body, the outer body having an opening for receiving an end of a cable that includes an inner conductor and an outer conductor;

a conducting contact portion coaxial with the outer body, the contact portion including a front portion and a rear portion, the rear portion having a hole therein substantially coaxial with the opening and a slot intersecting the hole for making a connection to a central conductor of the cable;

an annular insulator disposed within the outer body and surrounding the contact portion, thereby electrically isolating the contact portion from the outer body, wherein the insulator is formed from a ceramic or glass material;

a substantially cylindrical connecting body connecting to the outer body and coaxial with the opening; and a ring interior to the connecting body and coaxial with said opening, the ring having a slot therein that extends entirely through the ring so as to provide a complete break in the ring, the ring being configured to be closable by narrowing the slot to make a connection to the outer conductor of the cable.

7. An electrical connector according to claim 6, wherein the insulator is formed from a ceramic material.

8. An electrical connector according to claim 6, wherein the slot in the rear portion separates a first section and a second section of the rear portion, and the hole in the rear portion has a diameter less than that of the central conductor, so that, in operation, forcing the central conductor into the hole causes the slot to widen and the first section and the second section to resist being spread apart, thereby clamping the central conductor to the contact portion.

9. An electrical connector according to claim 6, wherein the connecting body has a threaded connection to the outer body, and the connecting body is tapered so that, in operation, threading the connecting body onto the outer body causes the ring to close on the cable, thereby clamping the outer conductor to the outer body.

10. An electrical connector according to claim 6, wherein the annular insulator includes a first ceramic insulator surrounding the contact portion, a second ceramic insulator surrounding the contact portion, and a gasket disposed axially between the first ceramic insulator and the second ceramic insulator, the gasket being formed of an elastomer material.

11. An electrical connector according to claim 10, wherein the elastomer material is rated for use at a temperature of at least 315° C., and for continuous duty at 300° C.

12. An electrical connector according to claim 10, wherein the elastomer material is a perfluoroelastomer.

13. An electrical connector according to claim 6, wherein the elastomer material is rated for use at a temperature of at least 315° C., and for continuous duty at 300° C.

14. An electrical connector according to claim 6, wherein the connector is configured to provide a solderless connection to at least one of the central conductor and the outer conductor of the cable.

* * * * *